US007354224B2

(12) United States Patent
Cinquano

(10) Patent No.: US 7,354,224 B2
(45) Date of Patent: Apr. 8, 2008

(54) ADJUSTABLE PILE SPLICING APPARATUS, SYSTEM, METHOD, AND PRODUCT-BY-PROCESS

(76) Inventor: John V. Cinquano, 21 Brittany Oaks, Clifton Park, NY (US) 12065

( * ) Notice: Subject to any disclaimer, the term of this patent is extended or adjusted under 35 U.S.C. 154(b) by 150 days.

(21) Appl. No.: 11/307,604

(22) Filed: Feb. 14, 2006

(65) Prior Publication Data

US 2006/0120810 A1 Jun. 8, 2006

(51) Int. Cl.
*E02D 5/08* (2006.01)

(52) U.S. Cl. ..... 405/251; 405/250; 405/279

(58) Field of Classification Search ..... 405/250, 405/251, 279

See application file for complete search history.

(56) References Cited

U.S. PATENT DOCUMENTS

| | | | | |
|---|---|---|---|---|
| 2,211,375 | A * | 8/1940 | Greulich | 405/251 |
| 2,296,336 | A * | 9/1942 | Crozier | 405/251 |
| 2,708,848 | A | 5/1955 | Pruyn | 405/251 |
| 2,978,874 | A | 4/1961 | Baittinger | 405/251 |
| 3,058,553 | A | 10/1962 | Hawes | 403/186 |
| 3,119,635 | A * | 1/1964 | Dealy et al. | 405/251 |
| 3,126,709 | A | 3/1964 | Dougherty | 405/251 |
| 3,333,429 | A | 8/1967 | Dougherty | 405/251 |
| 3,628,300 | A | 12/1971 | Tsurumi | 52/726.2 |
| 3,934,422 | A | 1/1976 | Fredrickson et al. | 405/225 |
| 4,053,247 | A | 10/1977 | Marsh, Jr. | 403/279 |
| 4,344,716 | A * | 8/1982 | Sigal | 403/13 |
| 4,537,534 | A * | 8/1985 | Marsh, Jr. | 405/251 |
| 4,605,340 | A | 8/1986 | Stephan | 405/252 |
| 4,610,571 | A | 9/1986 | Lees | 405/251 |
| 5,573,354 | A * | 11/1996 | Koch | 405/216 |
| 6,561,736 | B1 | 5/2003 | Doleshal | 405/251 |
| 6,684,577 | B2 * | 2/2004 | Dimitrijevic | 52/126.6 |
| 6,705,053 | B2 * | 3/2004 | Dimitrijevic | 405/450 |

FOREIGN PATENT DOCUMENTS

JP 6-146405 * 5/1994

OTHER PUBLICATIONS

Twenty-seven pages of correspondence, dated Aug. 15, 2006, between inventor John V. Cinquino and Bernia Mares of Versa Steel, Inc.

Invention disclosure prepared by applicant John V. Cinquino, and signed thereby on Jul. 15, 2005.

* cited by examiner

*Primary Examiner*—Frederick L. Lagman
(74) *Attorney, Agent, or Firm*—Jay R. Yablon

(57) ABSTRACT

Piles are spliced using a first splicer element comprising a first splicer face and a cross-section sized and contoured to mate with and press firmly against first faces of a pair of piles to be spliced; together with a second splicer element comprising a second splicer face and a cross-section sized and contoured to mate with and press firmly against second faces of said pair of piles to be spliced; together with an inter-facial connection and distance-adjustment apparatus for connecting said first and second splicer faces together firmly about said first and second faces of said pair of piles to be spliced, and for increasing or decreasing an interfacial distance between said first and second splicer faces at will.

21 Claims, 5 Drawing Sheets

ADJUSTABLE PILE SPLICING APPARATUS, SYSTEM, METHOD, AND PRODUCT-BY-PROCESS

FIELD OF THE INVENTION

This invention relates generally to the splicing of construction piles, and specifically, to a pile splicing apparatus which simplifies the splicing process by enabling fine adjustments to the interfacial distance between splicing surfaces at the splicing point.

BACKGROUND OF THE INVENTION

In the construction industry, H-piling is often driven to support bridges and other large structures. Sheet piling (also sometimes referred to as Z-piling) is often driven for cofferdams or similar retaining structures. In many instances it is necessary to splice the H-piling or sheet piling due to, for example, soil conditions or overhead constraints.

At present, there are two methods known in the art to perform such splicing. The first method is to drive a bottom section of piling, and then place another higher section of piling upon the bottom section. The joint is then welded with a full-penetration weld. The second method is to drive the bottom section of piling. Then, a pile splicer is placed on top of the bottom section. Then, another higher section of piling is placed atop the bottom section into the pile splicer. Finally, the splicer is welded, as are the flanges of the pilings themselves.

In the prior art, there exist mechanical splicers for both H-piling and sheet piling. The leading splicing apparatus, which is still widely used and has not been improved in over 50 years, is that disclosed in U.S. Pat. No. 2,708,828 and illustrated in FIGS. 1 and 2 herein, which are copied directly from FIGS. 2 and 5 respectively of U.S. Pat. No. 2,708,828. The two opposing faces (channels 27) of these splicers are fabricated integrally with a welded steel connecting lug (connector 30) which holds both faces of the splicer at a fixed distance from one another. Because of the permanently-connecting lug (30), this distance cannot be adjusted, and the two opposing splicer faces are not detachable and not separable.

In many instances, this permanent attachment and fixed distance makes it very difficult to slide the splicer onto the bottom piling section (20) due to extra material from mill tolerances or deformations at the top of the bottom section due to pounding from the pile hammer during driving. Often, to enable installation, the splicer must be beaten with a sledge hammer or the pile must be ground down with a hand-held grinder to remove the extra mill materials or the deformations from driving. This is time-consuming and costly in a pile driving operation.

Indeed, these sorts of problem are recognized and articulated in column 2, lines 11 through 37 of U.S. Pat. No. 2,708,828, where it is stated: "In driving the lower H-beam section 20 into the earth, the upper end may be considerably battered and distorted. In that event the upper end of this pile section would have to be squared as by burning off said upper end . . . . The dimensions of H-beams differ to a considerable extent and it is therefore necessary to provide for variations in clearance between the sleeve 24 and the H-beams 20 and 23. In order to avoid undesirable looseness, steel wedges could be used between the webs of the H-beams 20 and 23 and the webs 28 of channels 27 and between flanges 26 of the H-beams and flanges 29 of the channels 27. In subsequent driving by blows on the upper end of the upper pile section 23, said wedges may be loosened and fall out. It would therefore be desirable to secure them in position as by spot welding. In order to produce a strong connection the flanges 26 of the two H-beams 20 and 23 may be connected by welds 32 as indicated in FIGS. 4 and 7." (emphasis added.)

In the years since U.S. Pat. No. 2,708,828 was issued, there have been numerous devices invented for use in various pile driving and splicing applications. Patents which disclose some of these devices include U.S. Pat. Nos. 2,978,874; 3,058,553; 3,119,635; 3,126,709; 3,333,429; 3,628,300; 3,934,422; 4,053,247; 4,605,340; 4,610,571; and 6,561,736. However, despite over 50 years of motivation, none of these advances overcomes the fact that the distance between the two opposing faces (channels 27) of the U.S. Pat. No. 2,708,828 splicer cannot be adjusted. Therefore, other time-consuming and costly workarounds are still required, in industry practice, right up to the present day. This appears to be a limitation in the existing prior art for both H-piling and sheet-piling.

It would be desirable to have a device, system and method which avoids the need to grind or burn excess material from the piles or from the splicer, which eliminates the need for tightening wedges which as noted can be loosened or fall out without various spot welds, and which obviates the need for other workarounds required to obtain a secure and reliable splice because of the lack of adjustability of the U.S. Pat. No. 2,708,828 splicer and any other like splicers.

It would further be desirable to have a pile splicer which is adjustable, and in particular, in which the distance between the two opposing faces of the splicer can be readily adjusted. In this way, the distance between the two opposing faces can be increased so that the piles can be fitted into the splicer without grinding, burning, wedging, tack welding, etc., and then, once the piles are placed, the distance can be decreased to a very tight fit—again without grinding, burning, wedging, tack welding, etc.—before final permanent attachment, e.g., welding takes place.

SUMMARY OF THE INVENTION

Disclosed herein is a system and a related method, product-by-process, and apparatus for splicing piles, comprising: a first splicer element comprising a first splicer face and a cross-section sized and contoured to mate with and press firmly against first faces of a pair of piles to be spliced, wherein said first splicing element is detachable and separable from any second splicer element sized and contoured to mate with and press firmly against second faces of said pair of piles to be spliced; together with a second splicer element comprising a second splicer face and a cross-section sized and contoured to mate with and press firmly against second faces of said pair of piles to be spliced, wherein said second splicing element is detachable and separable from said first splicer element; together with an inter-facial connection and distance-adjustment apparatus for connecting said detachable and separable first and second splicer faces together firmly about said first and second faces of said pair of piles to be spliced, and for increasing or decreasing an interfacial distance between said first and second splicer faces at will.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing in which:

DETAILED DESCRIPTION

As noted earlier, FIGS. 1 and 2, which illustrate the prior art of U.S. Pat. No. 2,708,828, show a pair of opposing splicer faces (27) which are held in permanent fixed relation to one another—non-detachable and non-separable—via an integral connecting lug (30). As noted above and as discussed in U.S. Pat. No. 2,708,828, various workarounds are needed because this fixed distance between the opposing splicer faces (27) cannot be adjusted. These workarounds include the grinding, burning, wedging, spot welding, etc.

Figure 1:
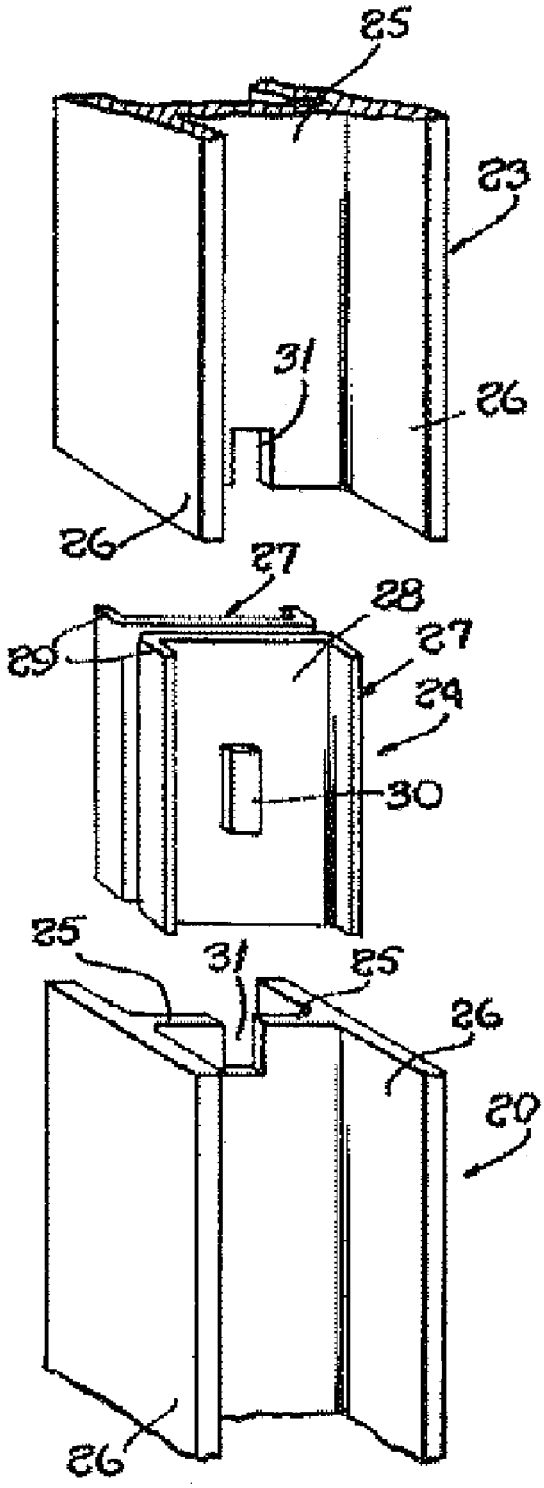
Figure 1 (Prior Art)
FIGS. 1 and 2 are copied from FIGS. 2 and 5 respectively of U.S. Pat. No. 2,708,828, and illustrate the prior art for splicing of H-piles and piles generally.
Figure 2:
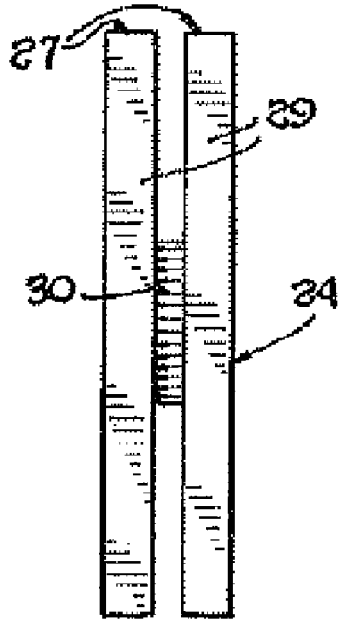
Figure 2 (Prior Art)
Figure 3:
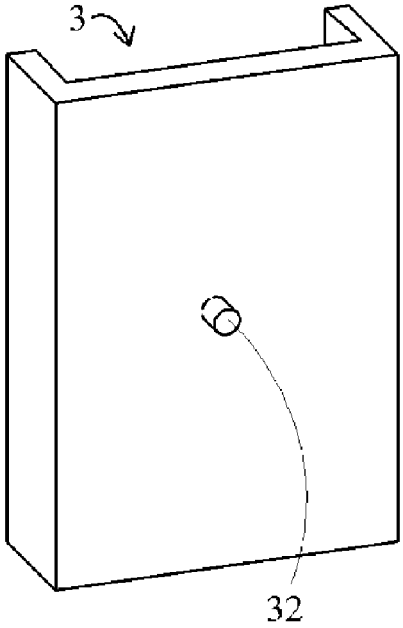
FIGS. 3 and 4 are perspective views illustrating "rear" and "front" ("first" and "second") splicer elements for a first preferred embodiment of the invention for splicing H-piles.
Figure 4:
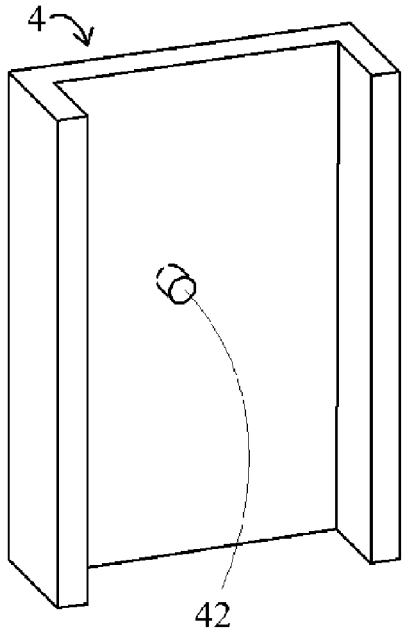
Figure 5:
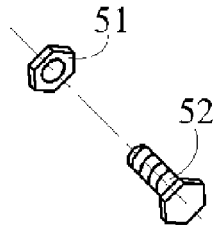
FIG. 5 is a perspective view illustrating a nut and bolt used to hold together in opposition and adjust the distance between these rear and front splicer elements in the first preferred embodiment.
Figure 6:
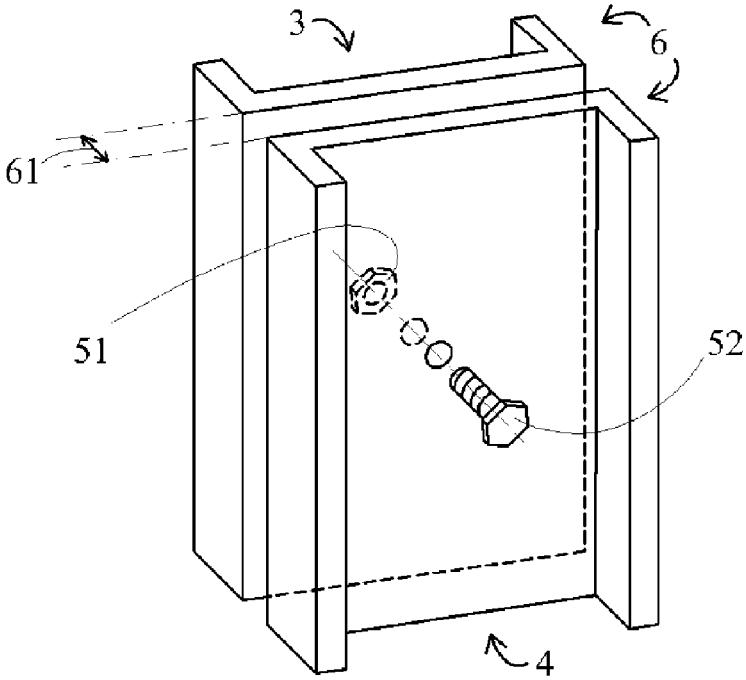
FIG. 6 is a perspective view illustrating the manner in which the nut and bolt of FIG. 5 are used to hold together in opposition and adjust the distance between these rear and front splicer elements of FIGS. 3 and 4.
Figure 7:
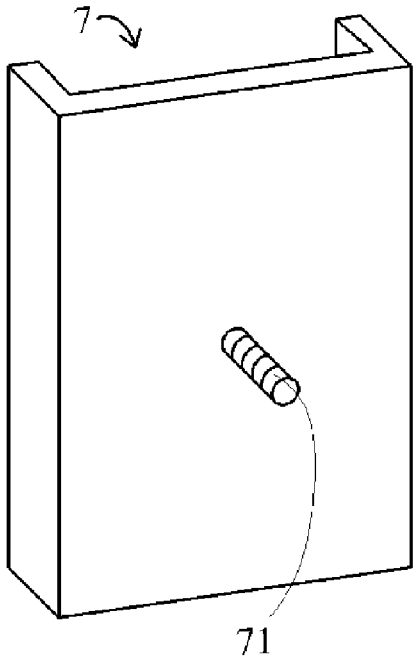
FIGS. 7 and 8 are perspective views illustrating rear and front splicer elements for a second preferred embodiment of the invention for splicing H-piles.
Figure 8:
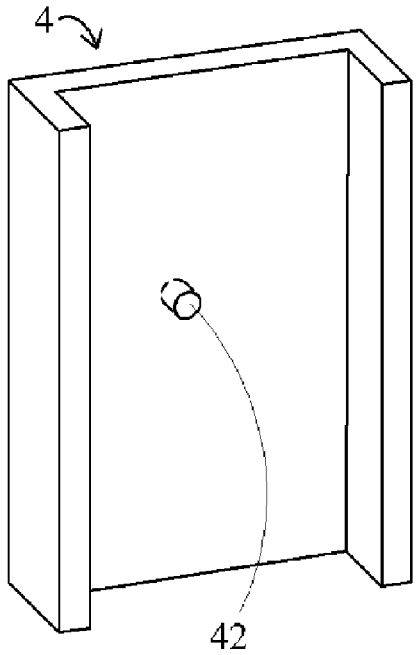
Figure 9:
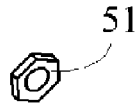
FIG. 9 is a perspective view illustrating a nut used to hold together in opposition and adjust the distance between these rear and front splicer elements in the second preferred embodiment.
Figure 10:
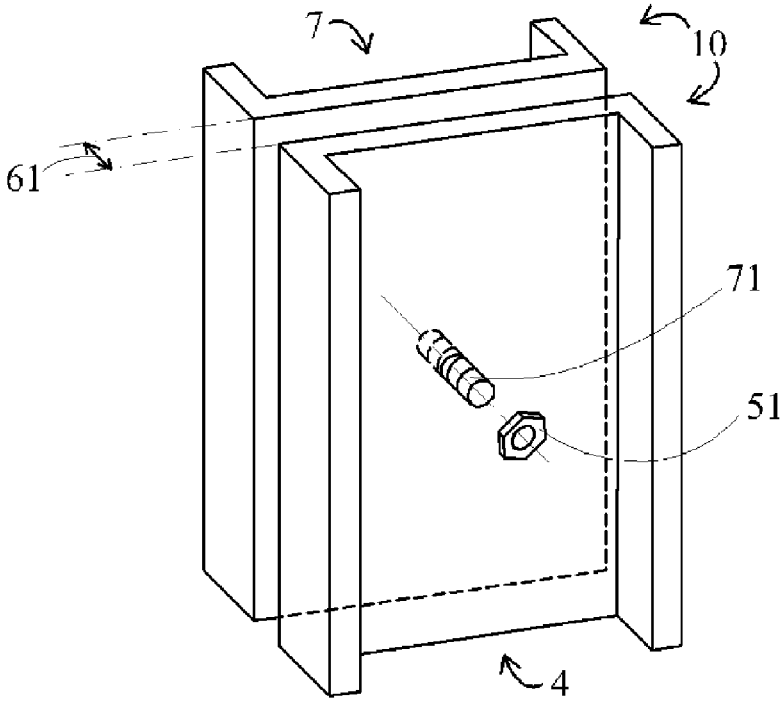
FIG. 10 is a perspective view illustrating the manner in which the nut of FIG. 9 is used to hold together in opposition and adjust the distance between these rear and front splicer elements of FIGS. 7 and 8.

The first preferred embodiment illustrated in FIGS. 3 through 6 is used to splice together two H-piles in the same manner as the prior art of FIGS. 1 and 2, except for the fact that the inter-facial distance 61 between the two opposing faces of splicer elements 3 and 4 with bolt apertures 32 and 42 can be altered by loosening or tightening the nut 51 and bolt 52 in FIG. 5. Thus, the improved pile splicer 6 in FIG. 6 serves a similar function and operates in similar manner as the prior art "sleeve 24" in FIG. 1 to splice together the two H-piles (20 and 23) of FIG. 1, except that the two opposing splicer elements 3 and 4 are detachable and separable and the inter-facial distance 61 between their two opposing faces can be narrowed or widened as the two piles are placed together end-to-end for splicing. The ability to adjust the inter-facial distance 61 between the two (preferably identical, for easy manufacturing) opposing splicer elements 3 and 4 overcomes the need for workarounds include grinding, burning, wedging, spot welding. If the width of either H-pile has expanded or other deformation have been introduced during pile driving, the inter-facial distance 61 can be made larger so the piles can be joined without burning or grinding. If the H-piles are for some reason a bit narrower due to mill tolerances or other factors, then rather than make use of spot-welded wedges, the inter-facial distance 61 can be made larger.

Figure 12:
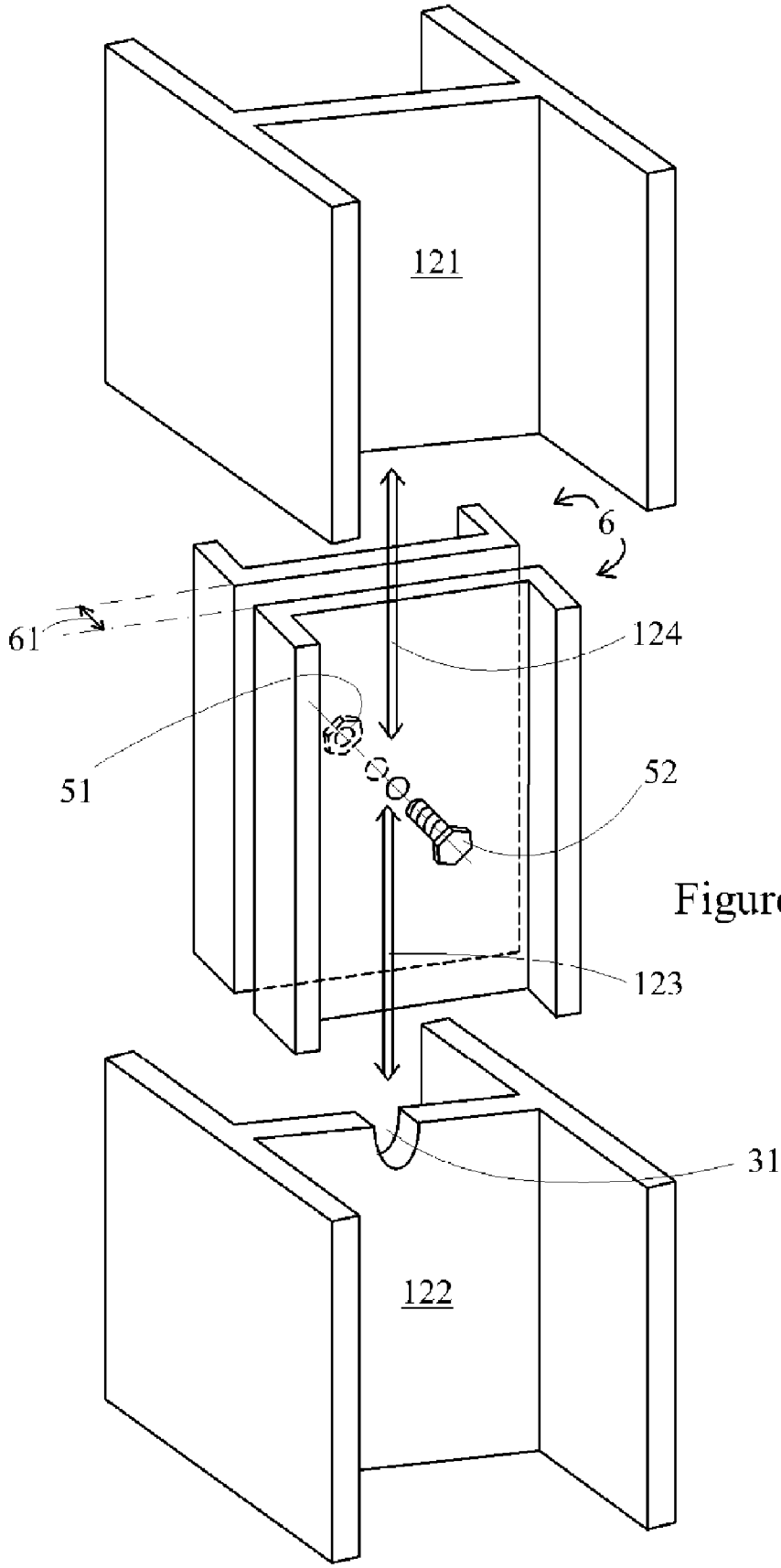
FIG. 12 is a perspective view of the embodiment of FIGS. 3 through 6, in connection with a pair of H-beams to be spliced.

Referring to FIG. 12, The method of using improved pile splicer 6 is as follows: First, notches are cut into the piles, similar to the notches (31) illustrated in FIG. 1. Alternatively, as illustrated in FIG. 12, a notch 31 is cut only into the top of lower pile 122. Then, one slides 123 the improved splicer 6 over the lower pile 122. It can be seen from FIGS. 1 and 12 that the H shape of the splicer elements 3, 4, when placed back to back, mate readily within the H shape of the H-pile. That is, the opposing splicer elements are sized and contoured to mate with and press firmly against the faces of the piles to be spliced. If there is resistance, the nut and bolt 51 and 52 are loosened until improved splicer 6 easily slides over the lower pile. The nut and bolt 51 and 52 may then be hand tightened. Next, the upper pile 121 is slid 124 into improved pile splicer 6. If there is a notch 31 in upper pile 121 as in FIG. 1, this notch is lined up with nut and bolt 51 and 52. Alternatively, if there is no notch as in FIG. 12, then alignment occurs utilizing the mating H-configurations for splicer 6 and H-pile 121. Again, if resistance is encountered, the nut and bolt 51 and 52 are loosened until the upper pile easily slides into improved splicer 6. At this point, a suitable wrench such as, but not limited to, an electrical impact wrench is used to firmly press the opposing splicer faces of splicer elements 3 and 4 about the pile joint by tightening nut and bolt 51 and 52. Finally, improved splicer 6 and the adjoining piles are permanently welded together or similarly attached, proximate the bottom of 121 and the top of 122, in the customary manner. Throughout this method, it is never necessary to burn or grind excess material because the inter-facial distance 61 can always be made larger at will, and it is never necessary to use any type of wedges because the inter-facial distance 61 can always be made smaller at will. This results in a significant saving of time and money.

It is to be observed that improved pile splicer 6 also permits an alternative method of splicing not possible with the prior art splicer of U.S. Pat. No. 2,708,828. In this method, one still cuts notches into the piles similar to the notches (31) illustrated in FIG. 1 or a single notch 31 in lower pile 122 as shown in FIG. 12. Next, however, one places bolt 52 through face of splicer element 3 only (recall that splicer elements 3 and 4 are preferably identical and thus interchangeable; thus, nut and bolt 51 and 52 can be oriented in either direction with respect to faces 3 and 4), and then rests the partial assembly of splicer element 3 and bolt 52 atop the lower pile, with bolt 52 resting within the notch (31) of the lower pile. Then, the upper pile is lowered into position with its notch (31) (if any) above bolt 52. Because the second splicer element 4 is not yet in place, the upper pile does not need to be slid longitudinally between the two splicer element 3 and 4, but can be moved laterally as well. Then, once the upper pile 121 (and its notch 31 if any) is properly placed above bolt 52, the bolt aperture 42 of second splicer face 4 is slid over the end of bolt 52, and then the nut 51 is placed onto end of bolt 52. The nut and bolt 51 and 52 are then firmly tightened, again with suitable wrench such as, but not limited to, an electrical impact wrench. Finally, once again, improved splicer 6 and the adjoining piles are permanently attached (e.g., welded) together in the customary manner.

A second preferred embodiment is illustrated in FIGS. 7 through 10. Here, first splicer element 7 is not identical to second splicer element 4 (the latter splicer element 4 is identical to that illustrated in FIG. 4), but instead is integrally fabricated with a bolt 71 spindle. Thus, loosening or tightening to adjust the interfacial distance involves loosening or tightening nut 51 over bolt 71 spindle. In all other respects, the method of use is the same as that for the embodiment of FIGS. 3 through 6. If one wishes to start with only one splicer element so as to permit lateral movement of the upper pile, then one would first place bolt spindle 71 of first splicer element 7 above the notch (31) of the lower pile. Then one would introduce the upper pile with its notch (31) (if any) above bolt 52.

In contrasting the embodiment of FIGS. 3 through 6 with that of FIGS. 7 through 10, it is clear that the most important feature that that the improved splicers 6, 10, comprise some "inter-facial connection and distance-adjustment apparatus" for widening and narrowing the inter-facial distance 61 between the first and second splicer elements and their opposing faces, and for connecting the mutually detachable and separable first and second splicer elements together. In the embodiment of FIGS. 3 through 6, this is achieved with nut and bolt 51 and 52. In the embodiment of FIGS. 7 through 10, this is achieved with nut 51 and bolt 71 spindle. Although these two particular approaches for adjusting interfacial distance 61 are illustrated here, it is understood that the substitution of other devices and combinations known or which may become known in the art for the purpose of widening and narrowing inter-facial distance 61 at will is also regarded to be within the scope of this disclosure and its associated claims.

An noted earlier, similar limitations exist in the prior art for sheet-piling a.k.a. Z-piling. Here too, splicing devices comprise suitably sized and contoured opposite splicing faces set at a fixed distance from one another.

Figure 11:
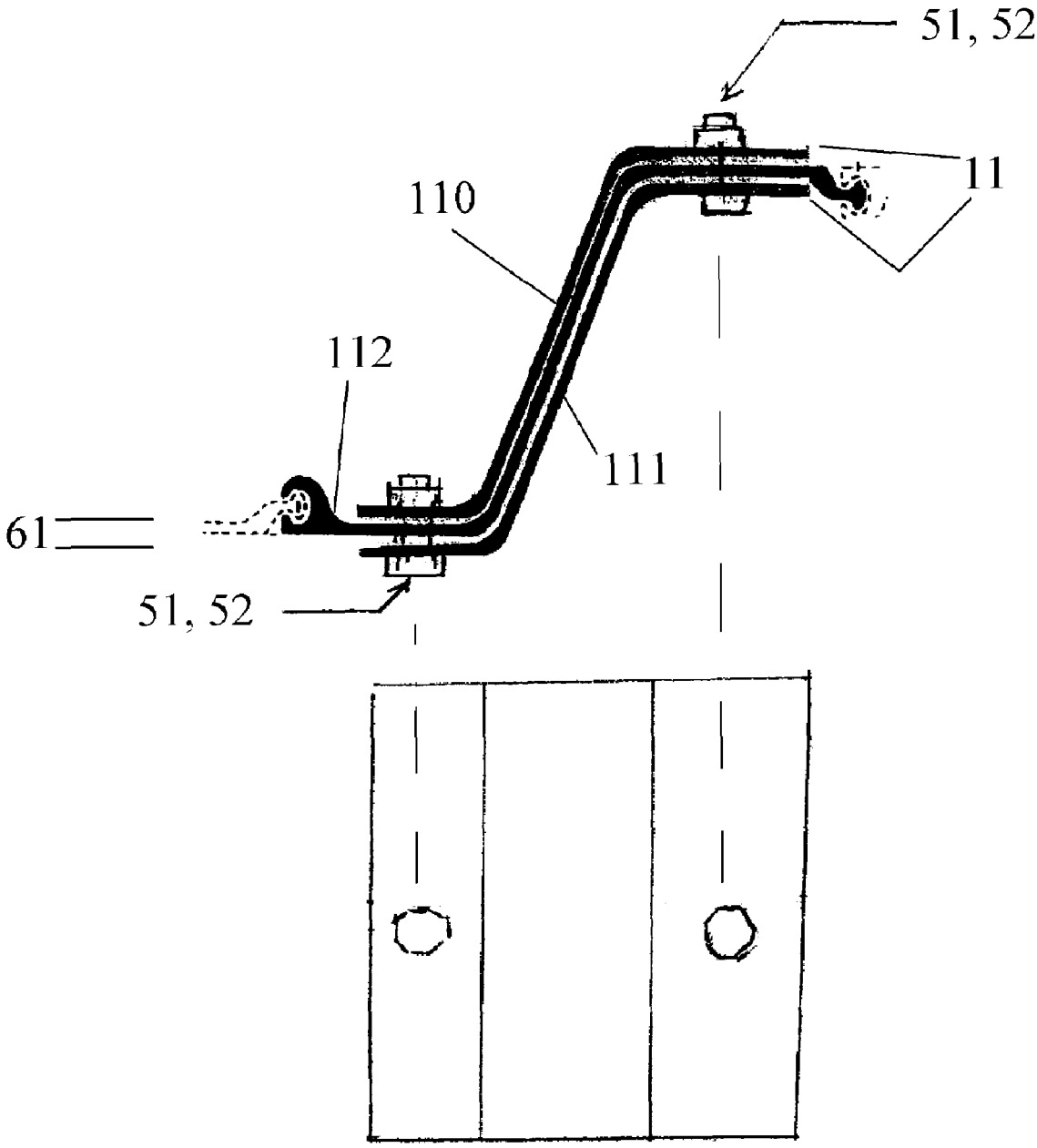
FIG. 11 is a top and side plan view illustrating a preferred Z-pile splicing embodiment of the invention.

A Z-piling embodiment of the invention is illustrated in FIG. 11. An improved sheet splicer 11 for Z-piles operates similarly to the improved H-pile splicers 6 and 10. The sheet-piles (Z-piles) 112 are held in place between first and second splicer elements 110 and 111. The inter-facial distance 61 between opposing faces is again made adjustable by operation of nuts and bolts 51 and 52. As regards the method of use, once a lower Z-pile 112 is in place and notched, the sheet splicer 11 is rested atop the notches as with the H-pile splicers, except that in this situation there are two (or more) notches and thus two (or more) corresponding bolts. The inter-facial distance 61 is then widened or narrowed as necessary to place an upper Z-pile 112, also with suitable notches, between the opposing faces of splicer elements 110 and 111. Because the inter-facial distance is adjustable, this is done without burning, grinding, wedging, tack welding, etc. Then the elements 110 and 111 of sheet splicer 11 are tightened together, and permanently attached (e.g., welded) together. As with the H-pile splicers, one can optionally start with only one splicer element 110 or 111 to permit lateral movement in placing the piles, and then add and tighten the second element 111 or 110 respectively to the first element once the piles have been properly aligned. Permanent welding or similar attachment then follows in the customary manner.

It is to be noted that the Z-piling illustrated in FIG. 11 is based on industry standard PZ27 Z-piling. However, this is not in any way limiting, and it is understood that this disclosure and its associated claims encompasses sheet splicers 11 configured in size and shape so as to mate with and properly secure and splice the full range of Z-piling which is or may become standard in the industry. Other industry-standard Z-piling configurations envisioned for sheet splicer 11 include, but are not limited to, PZ22, PZ35, PZ40, PSA23, PS27.5, PS31, PZC13, PZC18, AZ13, AZ18, AZ26, AZ36, AZ48, and any and all other piling configurations.

The products-by-process which result from using the pile splicer system and apparatus disclosed here according to the methods herein disclosed, includes a broad range of pile-based structures including, but not limited to, bridges, dams, cofferdams, retaining walls, and any and all other structures which use piling.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A system for splicing piles, comprising:

i) a first splicer element comprising:

a first splicer face; and a non-planar cross-section sized and contoured to mate with and press firmly against first faces of a pair of piles to be spliced and, via said sizing and contour, to bring said piles into proper longitudinal alignment for subsequent permanent attaching;

ii) a second splicer element comprising:

a second splicer face; and a non-planar cross-section sized and contoured to mate with and press firmly against second faces of said pair of piles to be spliced and, via said sizing and contour, to bring said piles into proper longitudinal alignment for subsequent permanent attaching; and iii) an inter-facial connection and distance-adjustment apparatus for connecting said detachable and separable first and second splicer faces together firmly about said first and second faces of said pair of piles to be spliced, and for increasing or decreasing an interfacial distance between said first and second splicer faces at will; wherein:

said first splicing element is detachable and separable from said second splicer element sized and contoured to mate with and press firmly against second faces of said pair of piles to be spliced; and said inter-facial connection and distance-adjustment apparatus is positioned upon said first and second splicer faces such that when said pair of piles is spliced, it does not pass entirely circumscribed through either pile, but only passes through at least one open notch at the very end of one or both piles.

2. The system of claim 1, said inter-facial connection and distance-adjustment apparatus comprising:

at least one first aperture in said first splicer face;

at least one second aperture in said second splicer face;

at least one bolt passing through said first and second apertures; and at least one nut mating with said at least one bolt.

3. The system of claim 1, said inter-facial connection and distance-adjustment apparatus comprising:

at least one second aperture in said second splicer face;

at least one bolt attached to said first splicer face and passing through said at least one second aperture; and at least one nut mating with said at least one bolt.

4. The system of claim 1, said piles comprising H-piles.

5. The system of claim 1, said piles comprising Z-piles.

6. A method for splicing piles comprising:

connecting a first splicer face of a first splicer element with a second splicer face of a second splicer element using an inter-facial connection and distance-adjustment apparatus, wherein said first and second splicing elements are sized and contoured, with a non-planar cross-section, to mate with and press firmly against respective first and second faces of a pair of piles to be spliced and, via said sizing and contour, to bring said piles into proper longitudinal alignment for subsequent permanent attaching;

adjusting an interfacial distance between said first and second splicer faces such that said connected first and second splicer elements can readily slide over a top end of a lower member of said pair of piles to be spliced and such that a bottom end of an upper member of said pair of piles to be spliced can readily slide between said connected first and second splicer elements, using said inter-facial connection and distance adjustment apparatus, wherein said inter-facial connection and distance-adjustment apparatus is positioned upon said first and second splicer faces such that when said pair of piles is spliced, it does not pass entirely circumscribed through either pile, but only passes through at least one open notch at the very end of one or both piles;

sliding said connected first and second splicer elements over said top end of said lower member of said pair of piles to be spliced;

sliding said bottom end of said upper member of said pair of piles to be spliced between said connected first and second splicer elements;

decreasing said interfacial distance between said first and second splicer faces until said first and second splicer faces press tightly against said respective first and second faces of said pair of piles to be spliced, using said inter-facial connection and distance-adjustment apparatus;

permanently attaching together, said first and second splicer faces and said pair of piles to be spliced.

7. The method of claim 6, said permanently attaching comprising welding.

8. The method of claim 6, said inter-facial connection and distance-adjustment apparatus comprising:

at least one first aperture in said first splicer face;

at least one second aperture in said second splicer face;

at least one bolt passing through said first and second apertures; and at least one nut mating with said at least one bolt.

9. The method of claim 6, said inter-facial connection and distance-adjustment apparatus comprising:

at least one second aperture in said second splicer face;

at least one bolt attached to said first splicer face and passing through said at least one second aperture; and at least one nut mating with said at least one bolt.

10. The method of claim 6, said piles comprising H-piles.

11. The method of claim 6, said piles comprising Z-piles.

12. A structural pile-based product, constructed using a process for splicing piles, said process comprising:

connecting a first splicer face of a first splicer element with a second splicer face of a second splicer element using an inter-facial connection and distance-adjustment apparatus, wherein said first and second splicing elements are sized and contoured, with a non-planar cross-section, to mate with and press firmly against respective first and second faces of a pair of piles to be spliced and, via said sizing and contour, to bring said piles into proper longitudinal alignment for subsequent permanent attaching;

adjusting an interfacial distance between said first and second splicer faces such that said connected first and second splicer elements can readily slide over a top end of a lower member of said pair of piles to be spliced and such that a bottom end of an upper member of said pair of piles to be spliced can readily slide between said connected first and second splicer elements, using said inter-facial connection and distance-adjustment apparatus, wherein said inter-facial connection and distance-adjustment apparatus is positioned upon said first and second splicer faces such that when said pair of piles is spliced, it does not pass entirely circumscribed through either pile, but only passes through at least one open notch at the very end of one or both piles;

sliding said connected first and second splicer elements over said top end of said lower member of said pair of piles to be spliced;

sliding said bottom end of said upper member of said pair of piles to be spliced between said connected first and second splicer elements;

decreasing said interfacial distance between said first and second splicer faces until said first and second splicer faces press tightly against said respective first and second faces of said pair of piles to be spliced, using said inter-facial connection and distance-adjustment apparatus;

permanently attaching together, said first and second splicer faces and said pair of piles to be spliced.

13. The product-by-process of claim 12, said permanently attaching comprising welding.

14. The product-by-process of claim 12, said inter facial connection and distance-adjustment apparatus comprising:

at least one first aperture in said first splicer face;

at least one second aperture in said second splicer face;

at least one bolt passing through said first and second apertures; and at least one nut mating with said at least one bolt.

15. The product-by-process of claim 12, said inter-facial connection and distance-adjustment apparatus comprising:

at least one second aperture in said second splicer face;

at least one bolt attached to said first splicer face and passing through said at least one second aperture; and at least one nut mating with said at least one bolt.

16. The product-by-process of claim 12, said piles comprising H-piles.

17. The product-by-process of claim 12, said piles comprising Z-piles.

18. The product-by-process of claim 12, said product comprising a bridge.

19. The product-by-process of claim 12, said product comprising a dam.

20. The product-by-process of claim 12, said product comprising a cofferdam.

21. The product-by-process of claim 12, said product comprising a retaining wall.

* * * * *

UNITED STATES PATENT AND TRADEMARK OFFICE

CERTIFICATE OF CORRECTION

PATENT NO. : 7,354,224 B2
APPLICATION NO. : 11/307604
DATED : April 8, 2008
INVENTOR(S) : John V. Cinquino It is certified that error appears in the above-identified patent and that said Letters Patent is hereby corrected as shown below:

On the title page item (76), should be written as JOHN V. CINQUINO, not John V. Cinquano.

Signed and Sealed this

Fourth Day of November, 2008

JON W. DUDAS
*Director of the United States Patent and Trademark Office*